US006439385B1

(12) United States Patent
Remde

(10) Patent No.: US 6,439,385 B1
(45) Date of Patent: Aug. 27, 2002

(54) DEVICE FOR PACKING FLUORESCENT RING LAMPS

(75) Inventor: Jurgen Remde, Nuremberg (DE)

(73) Assignee: Flowil International Lighting (Holding) B.V. (NL)

( * ) Notice: Subject to any disclaimer, the term of this patent is extended or adjusted under 35 U.S.C. 154(b) by 0 days.

(21) Appl. No.: 09/674,078

(22) PCT Filed: Apr. 27, 1999

(86) PCT No.: PCT/EP99/02829

§ 371 (c)(1),
(2), (4) Date: Oct. 25, 2000

(87) PCT Pub. No.: WO99/55589

PCT Pub. Date: Nov. 4, 1999

(30) Foreign Application Priority Data

Apr. 29, 1998 (DE) ..... 198 19 176

(51) Int. Cl.[7] ..... B65D 85/42
(52) U.S. Cl. ..... 206/419; 206/303
(58) Field of Search ..... 206/303, 446, 206/493, 395, 396, 397, 418, 419, 420, 482

(56) References Cited

U.S. PATENT DOCUMENTS 2,973,858 A * 3/1961 Laneve et al. ..... 206/396
3,329,259 A * 7/1967 Mayer ..... 206/396
3,910,409 A 10/1975 Fortlage
4,140,218 A * 2/1979 Forte ..... 206/303

FOREIGN PATENT DOCUMENTS

DE 28 24 549 A1 6/1978

OTHER PUBLICATIONS

Sylvania Spec. No. 51A–1902–429.

* cited by examiner

*Primary Examiner*—Shian Luong
(74) *Attorney, Agent, or Firm*—Brooks & Kushman P.C.

(57) ABSTRACT

In a device for the packing of fluorescent ring lamps (1, 2, 3) comprising each a blank (4, 5, 6) at sheetlike material, preferredly corrugated board, which has been formed by folding along bending lines and by insert joints or glue joints into a planar envelope which at least partially covers and protects the respective lamp (1, 2, 3) and has two flat faces (10, 11; 12, 13; 14, 15) enclosing the lamp therebetween, a plurality of envelopes (7, 8, 9) of different sizes for the reception of lamps (1, 2, 3) of also different sizes is provided, the largest envelope (7) of which at its two flat faces (10, 11) having cut-outs (16, 17) which are adapted as to their dimensions to the dimensions of envelopes (8, 9) of smaller sizes for frictional and/or interlocking reception of same, so that from each face at least one smaller envelope (8, 9) can be inserted into the volume of the larger envelope (7) in such a manner that by several single packages there is formed a joint package which in assembled condition does not exceed the volume of the largest envelope (7) essentially, a joint package from which each single package can be removed without impairing the residual single packages.

10 Claims, 2 Drawing Sheets

DEVICE FOR PACKING FLUORESCENT RING LAMPS

Figure 1:
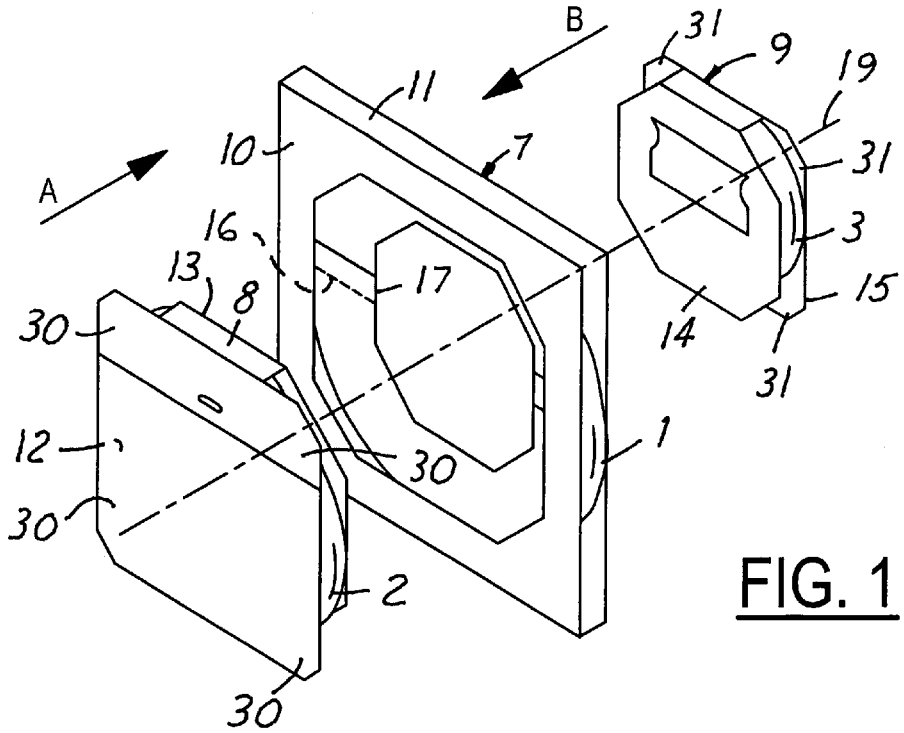

The invention relates to a device for the packing of fluorescent ring lamps comprising each a blank of sheetlike material, preferredly corrugated board, which has been formed by folding along bending lines and by insert joints or glue joints into a planar envelope which at least partially covers and protects the respective lamp and has two flat faces enclosing the lamp therebetween.

Packaging envelopes for tubular lamps, particularly ring lamps, manufactured using such a blank are known, v. DE 28 24 549 A1, FIG. 3. single packages or lamps in so-called folded boxes for shipping and sale are described therein. Also known is already a nest package for a 32 watts-and a 40 watts-ring lamp, respectively (SYLVANIA Spec. No. 51A-1902-429), in which both lamps are inserted in a corrugated board envelope, wherein the distance between the two lamps is fixed by manually depressing several brackets or tabs, respectively. In such a nest package the lamps can be offered for sale in common only, a single package is not present; if one of the lamps is removed from the nest package such lamp is without package.

The object underlying the invention is seen in providing a package for lamps, preferredly ring lamps, in which such envelopes, notwithstanding that the singular lamps are packed singularly in respective envelopes also, can be stuck together in such a manner that a stable and space saving overall or joint, resp., package results from which the single ring lamps can be removed together with their single package without affecting the consistency of the remaining combined or aggregate or joint, resp., package.

This object is met in accordance with the invention by providing a plurality of envelopes of different sizes for the reception of lamps of also different sizes, the largest envelope of which at its two flat faces having cut-outs which are adapted as to their dimensions to the dimensions of envelopes of smaller sizes for frictional and/or interlocking reception of same, so that from each face at least one smaller envelope can be inserted into the volume of the larger envelope in such a manner that from several single packages there is formed a joint package which in assembled condition does not exceed the volume of the largest envelope essentially, a joint package from which each single package can be removed without impairing the residual single packages.

Advantageously the device according to the invention assures that from the stuck together joint package each single package, also the largest, can be removed without impairing the other packages, insofar as the smaller packages in return can be secured to each other again without damaging or otherwise impairing anyone of the single packages. At the same time it is achieved that the joint package is practically not larger and assumes no larger volume than the package or envelope, resp., required for the largest lamp. This means a quite hefty saving in volume or space, resp., for storage and transportation.

According to a preferred embodiment of a device according to the invention for packing three fluorescent ring lamps with different diameters such that same within their single packages can be inserted into each other planely, the large envelope receiving the ring lamp having the largest diameter at one of its flat faces has a first cut-out which in shape and size is adapted to the shape and the size of the medium sized envelope receiving the ring lamp of medium sized diameter, for receiving the medium sized envelope, and at its other flat face has a second cut-out adapted in shape and size to the shape and the size of the small envelope receiving the ring lamp of smaller diameter, for receiving the small envelope. At the same time the medium sized envelope at its flat face turned towards the small envelope when inserting the medium sized envelope into the large envelope also has a cut out which as to its shape and size fits to the shape and site of the small envelope and is also destined for the positive and/or frictional reception of the latter, in such a manner that the three ring lamps can be arranged essentially concentrically to each other and essentially in one plane.

As to be seen, in each case the smaller lamp plus envelope takes advantage of the free space within the interior of the subsequent larger lamp plus its envelope.

The blank for each envelope suitably consists of a piece of material stamped out essentially rectangular and which vertically to its longitudinal axis has folding lines extending transversely, whereby two first folding lines by their respective distance delimit a first flat face of the envelope possessing, as the case may be, a cut-out, and two second folding lines extending parallel thereto in a distance corresponding to the width of the envelope and forming two end sections of the blank, which overlap each other after folding along the folding lines and after glueing or lashing together define a second flat face of the envelope which in the case of the large envelope provides also a cut-out.

Notwithstanding that such an envelope is open at two faces being opposed to each other, this is advantageous insofar as the lamp contained therein will become visible. At least in the case of the large envelope one can shape the edges of the blank and thereby the width of same somewhat larger for that the edges of the envelope might form a protection for the lamp as against getting touched. In case of the smaller envelopes with their smaller lamps inserted in the large envelope this is less important because the lamps after insertion into the large envelope are protected per se entirely and become visible in the same manner only after removing the large envelope.

In order to provide for a generally planar parallel arrangement of the medium sized and the small envelope in and at the large envelope, besides for an easier seizability and removability, the end sections of the medium sized and the small envelope which after their connection form the second flat face, suitably each define a larger area as the respectively first flat face which in the case of the medium sized envelope possesses a cut-out such that after insertion of these envelopes with their ring lamps into the respective cut-outs of the large envelope the end sections of this flat face form abutment areas for abutment at the flat faces of the large envelope.

At these abutment areas the medium sized and the smaller packaging envelope at oppositely situated flat faces, resp., of the large envelope can be seized and removed from same more easily and, by the way, reinserted also.

Should only the large envelope with the large ring lamp be removed or sold, resp., then it shows that subsequently the medium sized and the small envelopes with ring lamps arranged therein can be composed in the same manner as it was the case before by intermediate arrangement of the large envelope.

The invention provides, therefore, a particularly space saving transportation and storage of lamps arranged within such a joint package, and in addition thereto a respective advantageous presentation in the final market place also, of course. The removal of one of the three lamps with envelope from the joint package in accordance with the preferred embodiment with three ring lamps does not impair the integrity of the remaining package, more specifically: The removal of the small lamp with envelope leaver the medium sized lamp with envelope in its cut-out within the large lamp with envelope untouched and vice versa. Even if the large envelope with appertaining lamp is removed from the joint package, whereby of course the two other lamp packages must be detached to begin with, the latter subsequently can be put back into their original location at each other, hence the advantages as described are preserved also in this case.

Further advantageous developments of the invention are subject of additional dependent claims.

The invention and its advantageous developments are described in more detail in connection with an embodiment illustrated in the drawings as an example only.

In the drawings show

Figure 2:
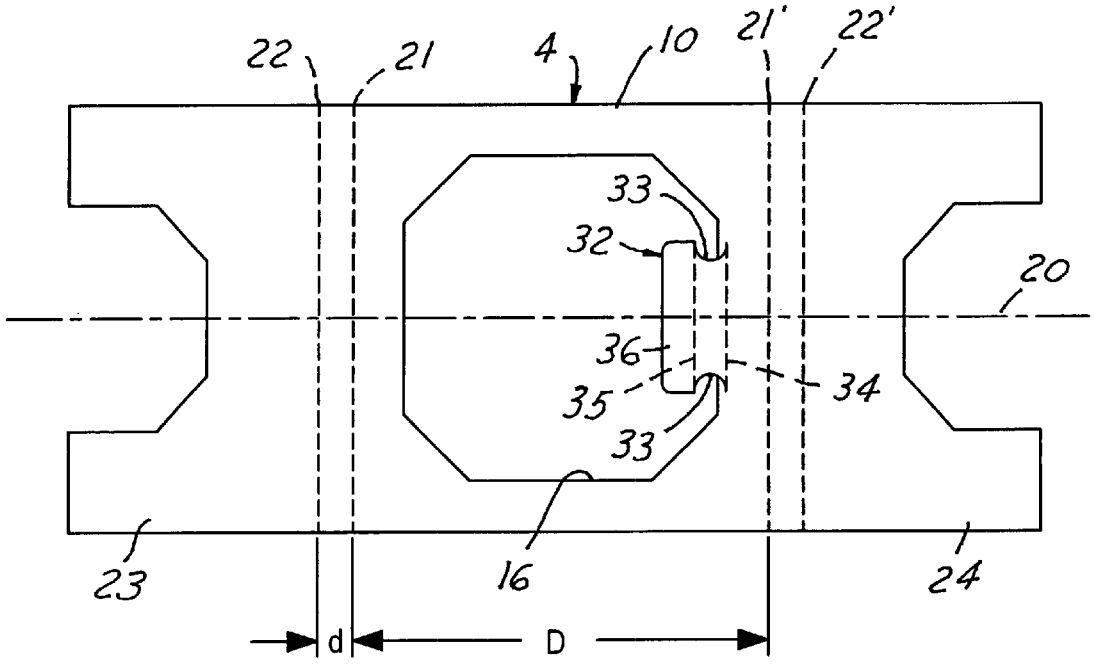
Figure 3:
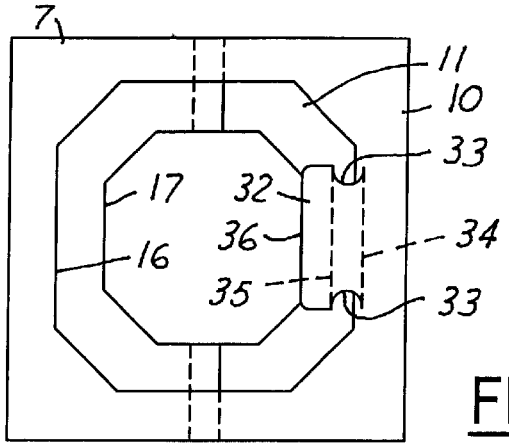
Figure 4:
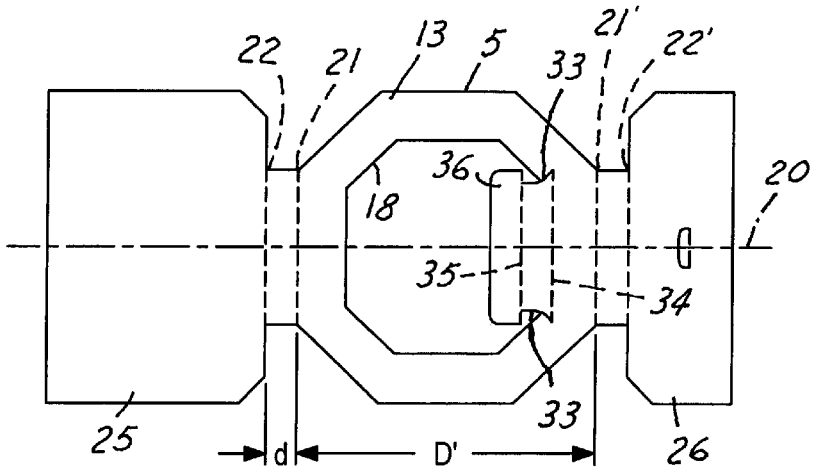
Figure 5:
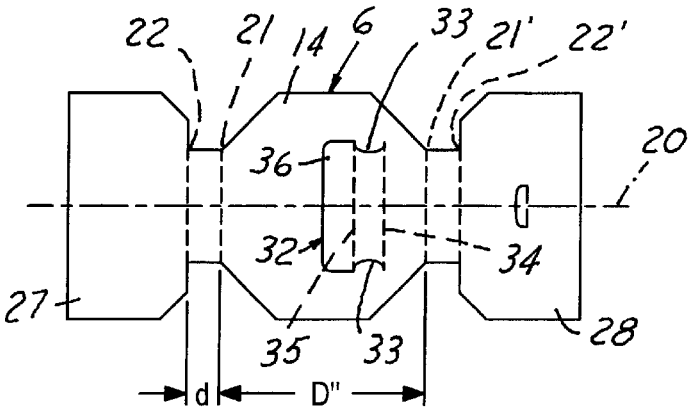

FIG. 1 a preferred embodiment of a device in accordance with the invention for packing three fluorescent ring lamps, in an explosion view;

FIG. 2 a top view of a blank for the manufacture of the large envelope for the reception of a large ring lamp corresponding to the envelope arranged in the center of FIG. 1;

FIG. 3 a top view of the envelope formed from the blank according to FIG. 2;

FIG. 4 a blank for the manufacture of a medium sized envelope for receiving of a medium sized ring lamp;

FIG. 5 a blank for the manufacture of a small envelope for the receiving of a relatively small ring lamp.

The illustrated device serves for packing lamps, particularly fluorescent ring lamps 1, 2 and 3 (FIG. 1) and comprises in each case a blank 4, 5, 6 (FIGS. 2, 4 and 5) of sheet material, preferredly corrugated board, which by folding along folding lines and lashing or glued connections has been formed into a flat even envelope 7, 8, 9 covering the respective lamp 1, 2, 3 at least partially and supporting same, comprising two flat faces 10, 11 or 12, 13 or 14, 15, resp., which enclose the lamp 1, 2, 3 therebetween.

In accordance with the invention there is provided a plurality of envelopes 7, 8, 9 of different sizes for receiving lamps 1, 2, 3 of different sizes also, the largest envelope 7 thereof at its two flat faces 10, 11 comprising cut-outs 16, 17 which as to their dimensions are adapted to the dimensions of envelopes 8, 9 of smaller size, for a frictional and/or positive acceptance of same. Therefore, from each side there is at least one smaller envelope 8, 9 insertable into the volume of the larger envelope 7, in such a manner that in combined condition a joint package has been formed from several single packages or envelopes 7, 8, 9, resp., which practically does not exceed the volume of the largest envelope 7, a joint package from which each single package can be removed without impairing the residual single packages, as shown in FIG. 1.

In the preferred embodiment shown for packing three fluorescent ring lamps 1, 2, 3 with different diameters such that the lamps with their single packages or envelopes 7, 8, 9, resp., can be posed into each other within a plane, the large envelope 7 receiving the ring lamp 1 of the largest diameter at one of its flat faces 10 comprises a first cut-out 16 as to its shape and size adapted to the shape and the size of the medium sized envelope 8 receiving the ring lamp 2 or medium sized diameter, for receiving the medium sized envelope 8, and at its other flat face 11 a second cut-out 17 adapted in its shape and size to the shape and the size of the small envelope 9 receiving the ring lamp 3 of the smallest diameter, for insertion of the small envelope 9. Besides the medium sized envelope 8 at its flat face 13 facing the small envelope 9 when inserted in the large envelope 7 comprises also a cut-out 18 (FIG. 4), a cut-out which as to its shape and size is adapted to the shape and size of the small envelope 9 and destined for frictionally and/or positively receiving the latter, such that the two ring lamps 1, 2, 3 are arranged generally concentrically to each other and generally in one plane, as can be understood by means of FIG. 1, namely by in mind sliding the envelope 8 in the direction of arrow A along central axis 19 shown in FIG. 1, and doing the same in the same manner with the small envelope 9 in the direction of arrow D, until the envelopes 8 and 9 with their sections defining the flat faces 12 and 15 abut the flat faces 10 and 11 of envelope 7.

As particularly shown in FIGS. 2, 4 and 5, the blank for each envelope 7, 8, 9 consists of a piece of material stamped out generally rectangular, a piece which comprises vertically to its longitudinal axis 20, resp., folding lines 21, 21' and 22, 22' extending transversely. Two first folding lines 21, 21' delimit a first flat face 10, 13, 14 of envelope 7, 8, 9 by their distance D, D' and D", the flat face having a stamped out recess 16, 17, 18, or cut-out, resp., as the case may be, and two second folding lines 22, 22' extending parallel thereto in a distance d corresponding to the thickness of the envelope and forming two end sections 23, 24 or 25, 26 or 27, 28 of each of the blanks 4, 5 and 6, resp., which after folding along the folding lines 22, 22' overlap each other and after glueing together or lashing define in common a second flat face 11, 12, 15 of the envelope 7, 8, 9, resp., which in the case of the large envelope 7 comprises also a cut-out 17.

As shown particularly in FIG. 1 clearly, the end sections 25, 26 and 27, 28 (FIGS. 4 and 5) which after their connection form the second flat faces 12 and 15 each, in each case define a larger area than the respective first flat face 13, 14, such that after insertion of these envelopes 8, 9 with their ring lamps 2, 3 in the respective cut-outs 16, 17 of the large envelope 7 the end sections 25, 26 or 27, 28, resp., of these second flat faces 12, 15 form abutment areas 30, 31 for abutment at the flat faces 10, 11 of the large envelope 7 and provide for a planar parallel arrangement of the medium sized and the small envelopes 8, 9 in and at the large envelope 7.

In addition thereto each blank 4, 5, 6 suitably comprises in at least one flat face 10, 13, 14 a folding tab 32 which after insertion of the lamp 1, 2, 3 to be packed can be pressed into the envelope 7, 8, 9 for abutment at the lamp for support and locking of same.

The folding tab 32 at its lateral ends suitably comprises notches 33 cut out for seizing the respective lamp body and for abutment thereat.

In the shown, preferred embodiment the notch area 33 are made arcuate for abutment at the wall of ring lamps 1, 2, 3. As to be bee from FIGS. 2 to 5, the tab 32 comprises two folding lines 34 and 35 distant from each other and extending parallel to the respective edge of the envelope, the folding lines comprising the notch areas 33 between them. The first folding line 34 defines the connection with the respective flat face 10, 13, 14 of the respective envelope 7, 8, 9 and the second folding line 35 defines an end section of the tab 32 destined for abutment at the opposite inner face of the respective envelope 7, 8, 9.

Notwithstanding that in the embodiment as shown the two smaller envelopes 8 and 9 in their areas facing the large envelope 7 and being inserted into same, as well as the respective recesses 16 and 17 of the large envelope 7, are optagonal each, it is to be understood, however, that such design is not obligatory; also round, elliptic or otherwise polygonal, but desirably symmetrical, configurations are possible.

What is claimed is:

1. Device for the packing of fluorescent ring lamps (1, 2, 3) comprising each a blank (4, 5, 6) of sheetlike material which has been formed by folding along bending lines and by insert joints or glue joints into a planar envelope which at least partially covers and protects the respective lamp (1, 2, 3) and has two flat faces (10, 11; 12, 13; 14, 15) enclosing the lamp therebetween, characterized in that a plurality of envelopes (7, 8, 9) of different sizes for the reception of lamps (1, 2, 3) of also different sizes is provided, said two flat faces (10, 11) of the largest envelope (7) having cut-outs (16, 17) which are adapted as to their dimensions to the dimensions of envelopes (8, 9) of smaller sizes for frictional and/or interlocking reception of same, so that from each face at least one smaller envelope (8, 9) can be inserted into the volume of the larger envelope (7) in such a manner that from several single packages there is formed a joint package which in assembled condition does not exceed the volume of the largest envelope (7) essentially, a joint package from which each single package can be removed without impairing the residual single packages.

2. Device according to claim 1 for packing three fluorescent ring lamps (1, 2, 3) with different diameters such that same within their single packages can be inserted into each other planely, characterized in that one of the flat faces (10) of the large envelope (7) receiving the ring lamp (1) having the largest diameter and a first cut-out (16) of the cut-outs (16, 17) which in shape and size is adapted to the shape and the size of the medium sized envelope (8) receiving the ring lamp (2) of medium sized diameter, for receiving the medium sized envelope (8), and at its other flat face (11) has a second cut-out (17) of the cut-outs (16, 17) adapted in shape and size to the shape and the size of the small envelope (9) receiving the ring lamp (3) of smaller diameter, for receiving the small envelope (9), and that the medium sized envelope (8) at its flat face (13) turned towards the small envelope (9) when inserting the medium sized envelope (8) into the large envelope (7) also has a cut-out (18) of a shape and size to fit the shape and size of the small envelope (8) and is also destined for the positive and/or frictional reception of the latter, in such a manner that the three ring (1, 2, 3) can be arranged essentially concentrically to each other and essentially in one plane.

3. Device according to claim 2 characterized in that the blank (4, 5, 6) for each envelope (7, 8, 9) comprises a piece of material stamped out essentially rectangular and which vertically to its longitudinal axis (20) has folding lines (21, 21'; 22, 22') extending transversely, whereby two first folding lines (21, 21') by their respective distance (D, D', D") delimit a first flat face (10, 13, 14) of the envelope (7, 8, 9) possessing, as the case may be, a cut-out (16, 17, 18), and two second folding lines 22, 22') extending parallel thereto in a distance (d) corresponding to the width of the envelope and forming two end sections (23, 24; 25, 26; 27, 28) of the blank (4, 5, 6), which overlap each other after folding along the folding lines (22, 22') and after securing together define a second flat face (11, 12, 15) of the envelope (7, 8, 9).

4. Device according to claim 1 characterized in that the blank (4, 5, 6) for each envelope (7, 8, 9) comprises a piece of material stamped out essentially rectangular and which vertically to its longitudinal axis (20) has folding lines (21, 21'; 22, 22') extending transversely, whereby two first folding lines (21, 21') by their respective distance (D, D', D") delimit a first flat face (10, 13, 14) of the envelope (7, 8, 9) possessing, as the case may be, a cut-out (16, 17, 18), and two second folding lines 22, 22') extending parallel thereto in a distance (d) corresponding to the width of the envelope and forming two end sections (23, 24; 25, 26; 27, 28) of the blank (4, 5, 6), which overlap each other after folding along the folding lines (22, 22') and after securing together define a second flat face (11, 12, 15) of the envelope (7, 8, 9).

5. Device according to claim 4, characterized in that the end sections (25, 26; 27, 28) of the medium sized and the small envelope (8, 9) which after their connection form the second flat face (12, 15), suitably each define a larger area as the respectively final flat face (13, 14) such that after insertion of these envelopes (8, 9) with their ring lamps (2, 3) into the respective cut-out (16, 17) of the large envelope (7) the end sections (25, 26; 27, 28) form abutment areas for abutment at the flat faces (10, 11) of the large envelope (7) and serve for an essentially planar parallel arrangement of the medium sized and the small envelopes (8, 9) in and at the large envelope (7).

6. Device according to claim 5, characterized in that each blank (4, 5, 6) in at least one flat face (10, 13, 14) has a folding tab (32) which after insertion of the lamp (1, 2, 3) to be packed can be pressed into the envelope (7, 8, 9) for abutment at the lamp for support and fixation of same.

7. Device according to claim 6, characterized in that the folding tab (32) at the tab's lateral ends comprise notches (33) cut-out for engaging the respective lamp body.

8. Device according to claim 7, characterized in that the notch areas (33) are made arcuate for abutment at the wall of the ring lamps (1, 2, 3).

9. Device according to claim 8, characterized in that the tab (32) comprises two folding lines (34, 35) distant from each other and extending parallel to the respective edge of the envelope, the folding lines comprising the notch areas (33) between them, and first folding line (34) defining the connection with the respective flat face (10, 13, 14) of the respective envelope (7, 8, 9) and the second folding line (35) defining an end section (36) of the tab (32) destined for abutment at the opposite inner face of the respective envelope (7, 8, 9).

10. The device according to claim 1 in which said sheetlike material is corrugated board.

* * * * *